US006552641B1

(12) United States Patent
Carvalheiro et al.

(10) Patent No.: US 6,552,641 B1
(45) Date of Patent: Apr. 22, 2003

(54) TRANSFORMER, ESPECIALLY FOR POWERING CATHODE RAY TUBES

(75) Inventors: Paul Carvalheiro, Arc les Gray (FR); Philippe Fuentes, Dijon (FR)

(73) Assignee: Thomson Licensing S.A., Boulogne Billancourt (FR)

( * ) Notice: Subject to any disclaimer, the term of this patent is extended or adjusted under 35 U.S.C. 154(b) by 85 days.

(21) Appl. No.: 09/617,157

(22) Filed: Jul. 17, 2000

(30) Foreign Application Priority Data

Jul. 27, 1999 (FR) ..... 9909728

(51) Int. Cl.[7] ..... H01F 27/02

(52) U.S. Cl. ..... 336/92; 336/192; 336/194; 336/198; 336/208; 336/96

(58) Field of Search ..... 336/92, 192, 194, 336/198, 208, 96; 323/307, 308

(56) References Cited

U.S. PATENT DOCUMENTS

| | | | | |
|---|---|---|---|---|
| 3,118,122 A | | 1/1964 | Jenot | |
| 4,408,176 A | * | 10/1983 | Nakamura | 336/107 |
| 4,549,130 A | * | 10/1985 | Dobberstein | 323/308 |
| 4,617,543 A | * | 10/1986 | Akachi et al. | 336/192 |
| 5,898,354 A | * | 4/1999 | Lee | 336/96 |
| 6,133,698 A | * | 10/2000 | Rouhier et al. | 315/415 |

FOREIGN PATENT DOCUMENTS

| | | |
|---|---|---|
| DE | 3822284 | 1/1990 |
| EP | 0043615 | 1/1982 |
| EP | 0324084 | 7/1989 |
| GB | 2033669 | 5/1980 |
| GB | 2112746 | 7/1983 |
| WO | 99/03118 | 1/1999 |

OTHER PUBLICATIONS

Search Report for French Patent Application No. 9909728, Apr. 2000.

* cited by examiner

*Primary Examiner*—Elvin Enad
*Assistant Examiner*—Jennifer A. Poker
(74) *Attorney, Agent, or Firm*—Joseph S. Tripoli; Harvey D. Fried; Joseph J. Kolodka

(57) ABSTRACT

A transformer comprises a first support carrying a primary winding and a second support carrying a partial secondary winding connected electrically to an electrical unit by way of conductive wires.

A flange of the second support exhibits at least two indentations for receiving a conductive wire which are separated by a recess filled with insulating material.

10 Claims, 9 Drawing Sheets

TRANSFORMER, ESPECIALLY FOR POWERING CATHODE RAY TUBES

FIELD OF THE INVENTION

The present invention relates to transformers, especially for powering cathode ray tubes.

BACKGROUND OF THE INVENTION

Conventionally, a transformer comprises at least one primary winding mounted on a first support and at least one secondary winding mounted on a second support.

A known manner of constructing a high-voltage transformer consists in providing partial secondary windings linked in series by way of diodes. Conductive wires of general direction parallel to the axis of the windings connect the partial secondary windings to the diodes, to the electrical connection terminals or to any other electrical unit.

These conductive wires are guided by indentations defined on a flange of the second support. It is generally considered necessary to provide a sufficient distance between two indentations to avoid the creation of electric arcs.

SUMMARY OF THE INVENTION

The invention seeks to reduce the dimensions of the transformer and consequently the distance between two indentations, without risking the creation of electric arcs.

To realize such a goal, the invention proposes to separate the indentations by a recess filled with 35 insulating material.

Through the presence of the recess filled with insulating material, the two conductive wires are insulated even at the level of the guiding indentations; thus no discharge will occur along the circumference of the second support.

The invention is of particular interest when the second support is situated inside the first support, as described in patent application WO 99/03118.

In order to further reduce the dimensions of the transformer, the invention proposes a preferred solution, wherein the first support is a substantially constant first distance from the second support over a first part of its periphery and a distance greater than the first distance over a second part of its periphery, and wherein the conductive wires are placed in line with the second part.

According to other advantageous features,

- at least one diode is received between the second support and a partial secondary winding;
- a magnetic circuit forms a window traversed by the first support and the second support at the level of the said first part;
- the assembly of electrical units is situated outside the magnetic circuit;
- a first duct for receiving a first cable carries at least one clip for retaining a second cable associated with a second duct;
- the first support and the second support are received in a vessel filled with said insulating material;
- said insulating material is a resin;
- the transformer is used for powering a cathode ray tube.

BRIEF DESCRIPTION OF THE DRAWINGS

The description which follows will be given with reference to the appended drawings in which.

DETAILED DESCRIPTION OF PREFERRED EMBODIMENTS

Figure 1:
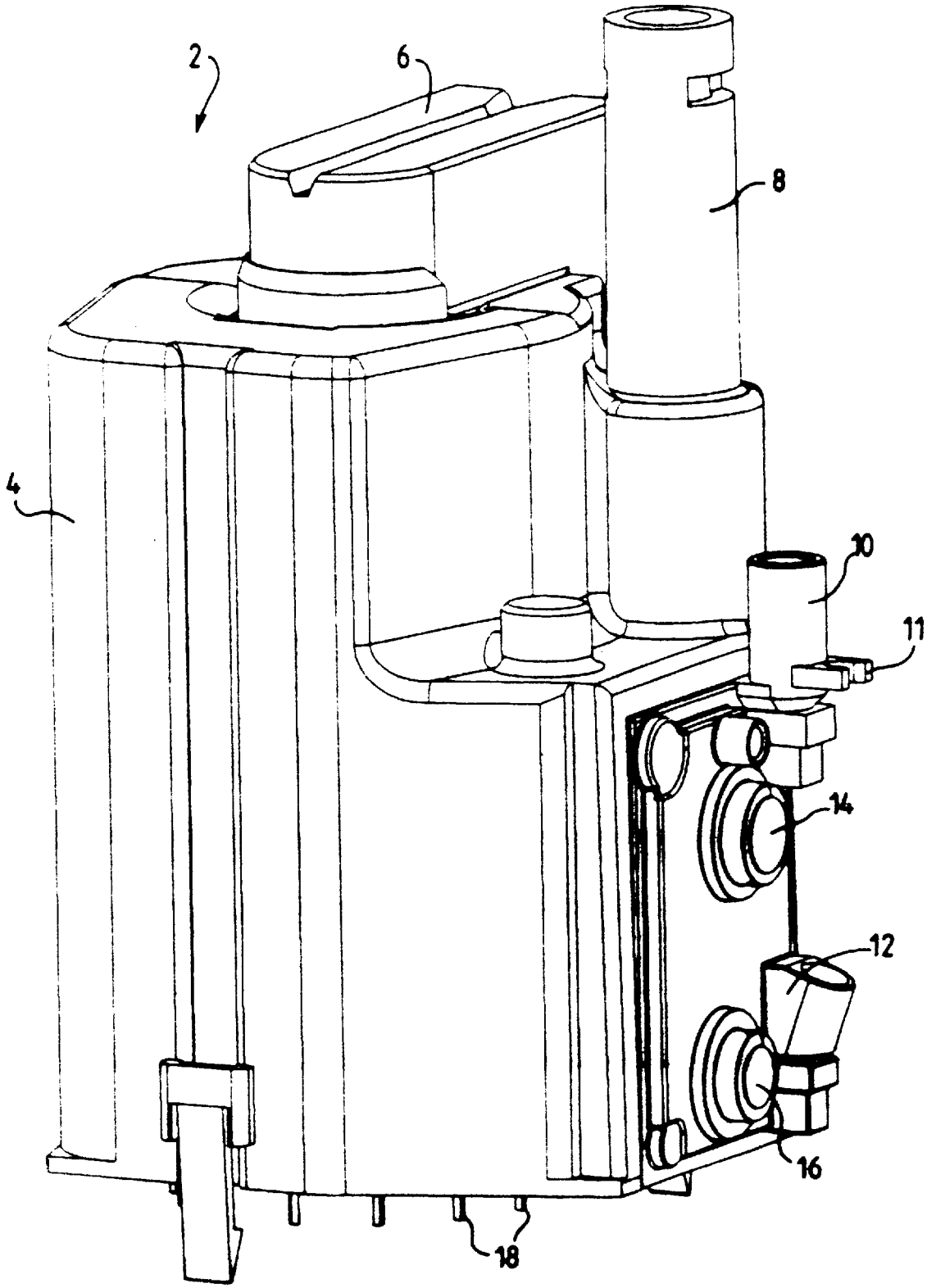
FIG. 1 represents a perspective view of a transformer according to a first embodiment of the invention.

FIG. 1 represents a high-voltage transformer 2. Such a transformer 2 is for example used for the electrical powering of a cathode ray tube such as those which are used in televisions or in monitors. These transformers must output (at the secondary) voltages of the order of 20–30 kV.

The transformer 2 comprises a vessel (or casing) 4 which receives the electrical elements and which is traversed by a magnetic circuit 6. The vessel possesses a duct 8 intended for receiving a high-voltage cable for powering the cathode ray tube. The vessel also possesses two ducts of reduced size 10, 12 for receiving cables for biasing the grids of the cathode ray tube. One of the ducts of reduced size 10 carries clips 11 for retaining the cable which has to be received in the other duct of reduced size 12. The transformer 2 also comprises two potentiometers 14, 16 for adjusting the grid biasing voltages. The transformer furthermore comprises lugs 18 for connection to the printed circuit on which it is to be mounted.

Figure 2:
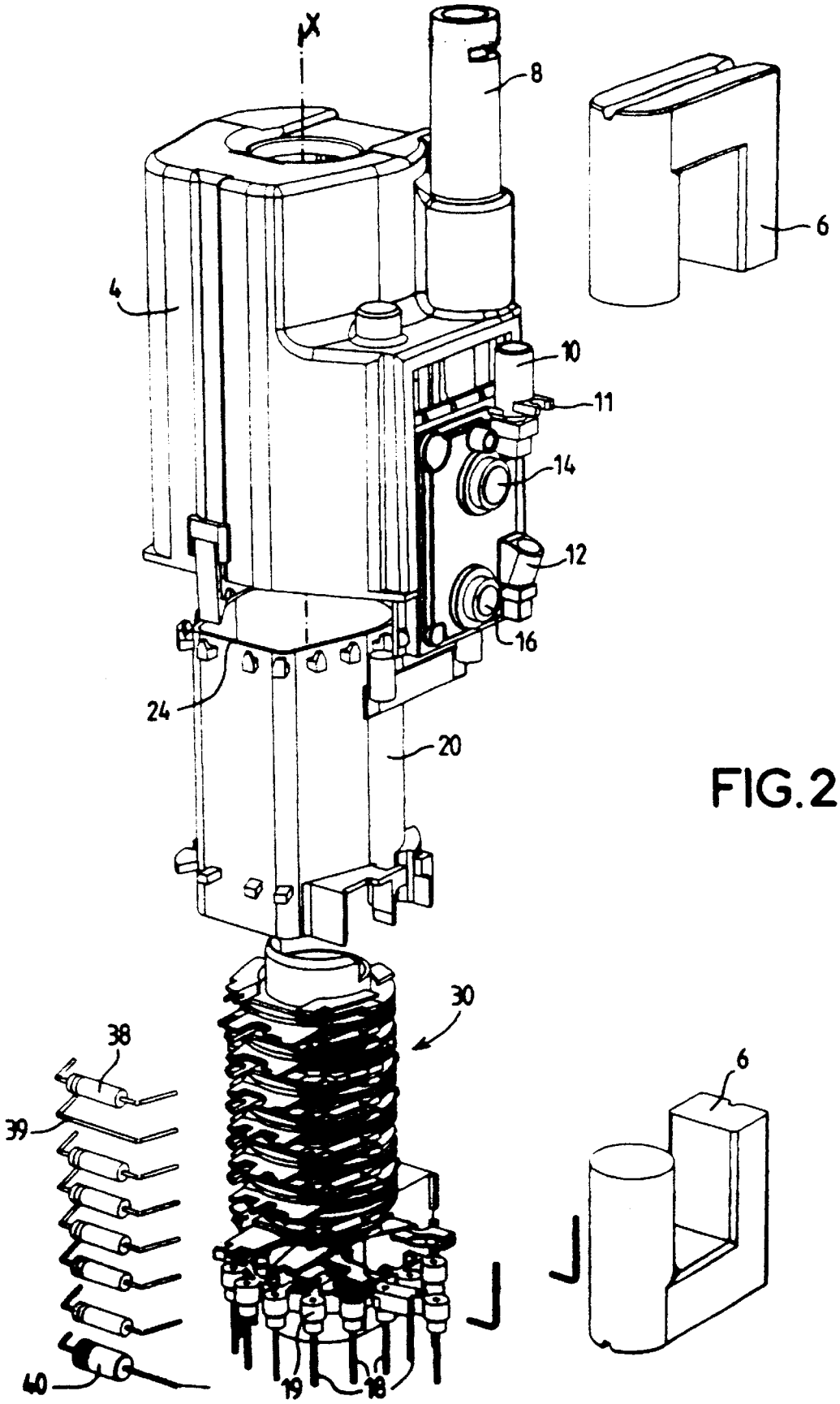
FIG. 2 represents the transformer of FIG. 1 in an exploded view.

Represented in FIG. 2 is an exploded view of the transformer of FIG. 1. The transformer 2 comprises a first support 20 and a second support 30. The first support 20 and the second support 30 are of general cylindrical shape, defining a windings axis X.

The first support 20 carries a primary winding of the transformer 2. The second support 30 carries an assembly of partial secondary windings (not represented). The partial secondary windings are situated inside the first support, that is to say that in a section through a plane perpendicular to the X axis at the level of the partial secondary windings the circumference of the second support 30 is received inside the circumference of the first support 20.

Figure 3:
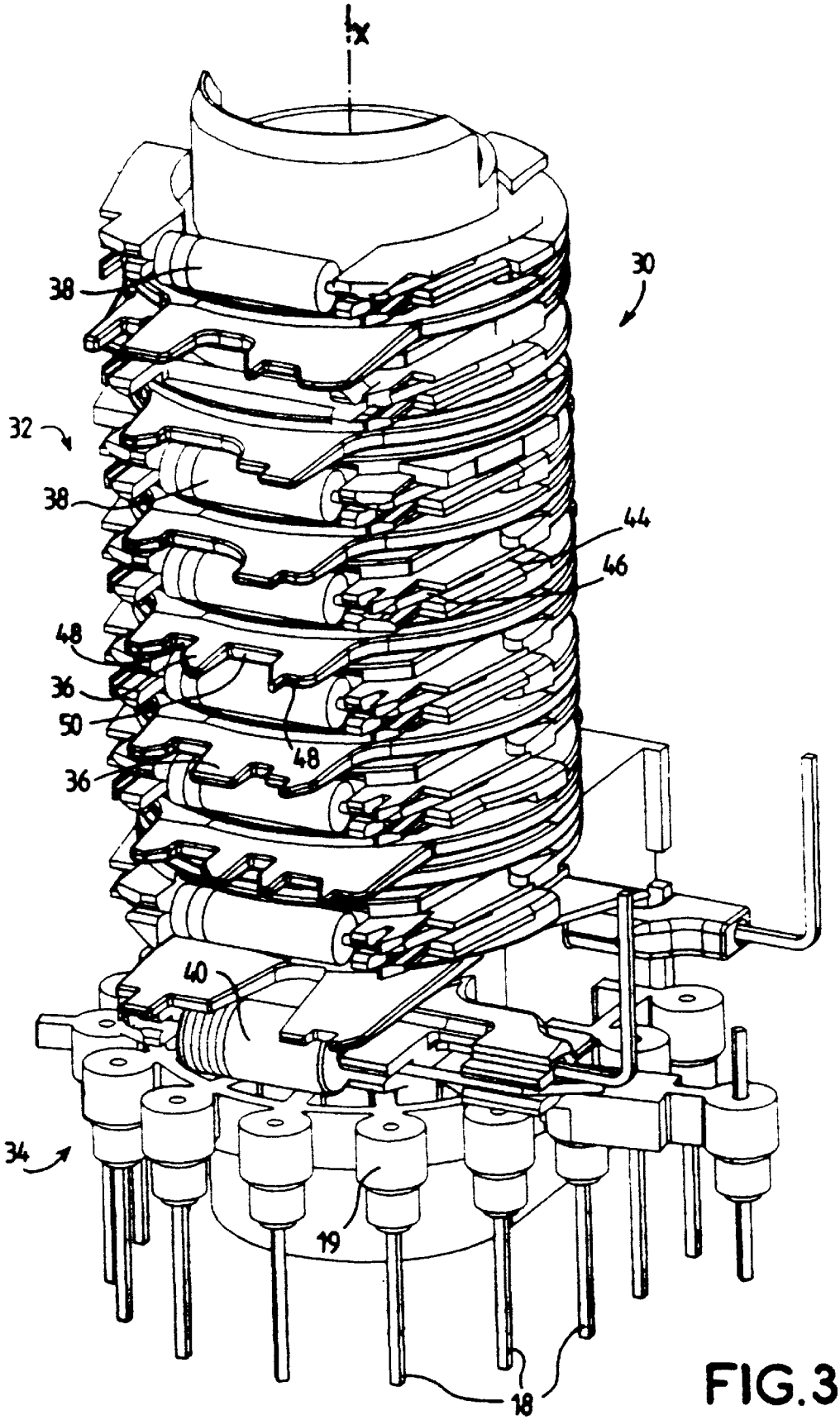
FIG. 3 represents some of the elements of the transformer of FIG. 1 in perspective.

The second support 30 (FIG. 3) comprises an upper part 32 which receives the partial secondary windings 32 and a lower part 34 which carries the connection lugs 18 by means of clips 19. The upper part 32 has the general shape of a cylinder of revolution.

On one side (that is to say on one part only of its circumference, typically between 60° and 120° of the circumference—around the X axis—, approximately 90° in the case represented), the upper part 32 of the second support 30 comprises flanges 36 which extend outwards from the cylinder of revolution, perpendicularly to the X axis.

Figure 4:
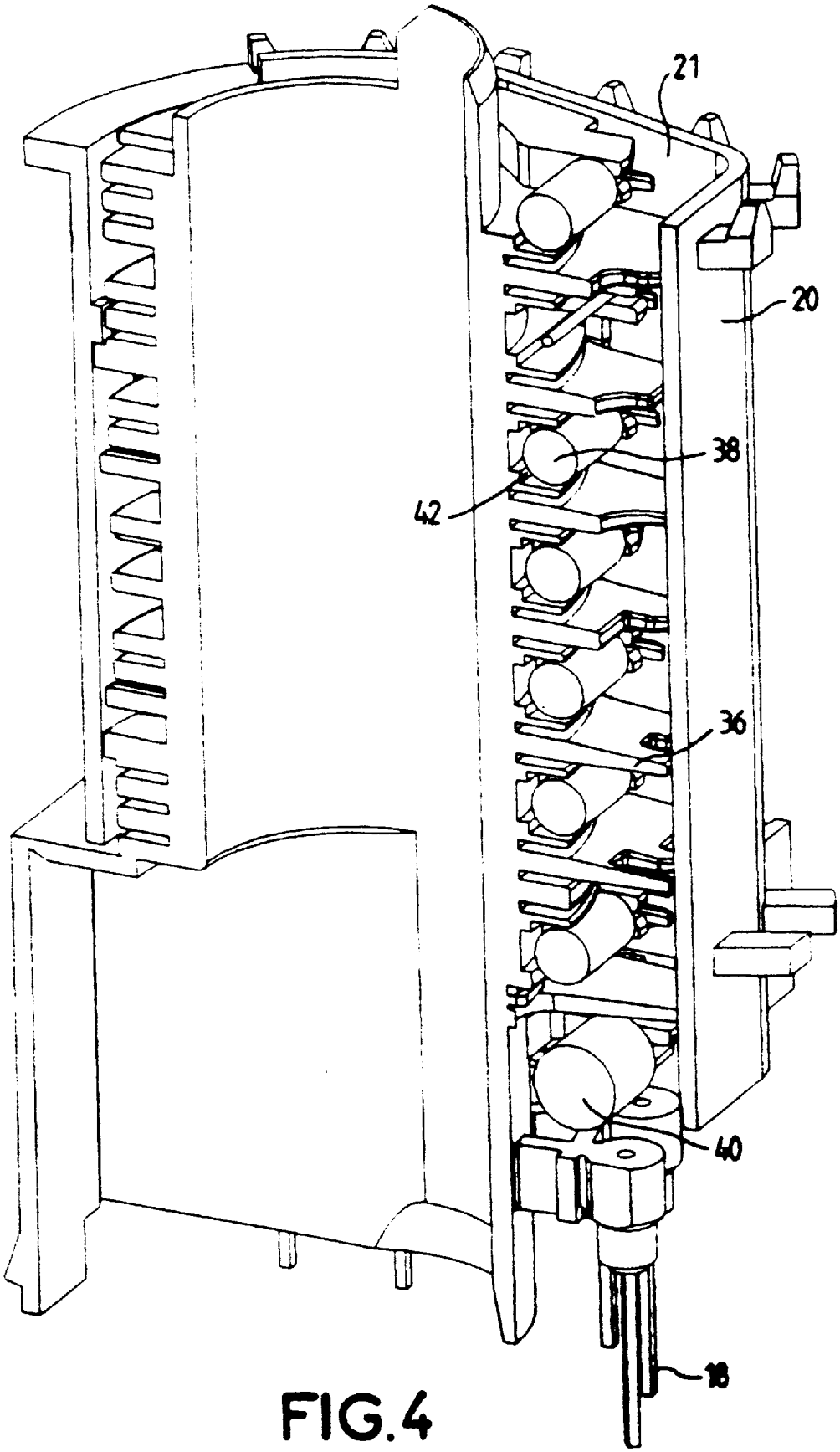
FIG. 4 represents some of the elements of the transformer of FIG. 1 in a cutaway view.

The partial secondary windings are linked in series by way of diodes 38 and a resistor 40. The embodiment represented comprises 6 diodes 38 and 1 resistor 40. Certain of the diodes 38 (here 5) are received between two adjacent flanges 38 in a housing 42 provided for this purpose (FIG. 4).

It is noted that in the embodiment represented all the diodes 38 and the resistor 40 are received on the second support 30 on the same side (side already mentioned above), parallel to one another, perpendicular to the X axis, tangential to the upper part 32 of the second support 30, and outside the window formed by the magnetic circuit 6 (consisting in practice of two half-circuits), thereby making it possible to reduce the size of the latter.

The second support 30 also comprises, on its periphery, grooves 44 for receiving the folded-back connection clips 46 for the diodes 38. The connection clips 46 are folded back so as to be tangential to the cylinder formed by the upper part 32 at the level of the grooves 44.

The partial secondary windings are made on the assembly consisting of the second support 30, the diodes 38 and the resistor 40. Certain of the diodes 38 are therefore received between the second support 30 and a secondary winding.

It may be noted that at the level of a particular partial secondary winding the second support 30 comprises a metal linking rod 39 instead of a diode 38.

The flanges 36 exhibit indentations 48 for receiving and guiding conductive wires which extend parallel to the X axis and which connect the partial secondary windings to the diodes 38 (and to the resistor 40) or the connection lugs 18.

The flanges comprising at least two indentations 48 also exhibit a recess 50 situated between these two indentations 48. The vessel 4 is filled outside of the elements described hereinabove with a resin which constitutes an insulating material. In particular, the recess 50 of the flange 36 is filled with this same insulating material thereby making it possible to improve the insulation between the conductive wires of the two indentations 48. It is thus possible to place a considerable number of electric wires in a reduced volume.

Figure 5:
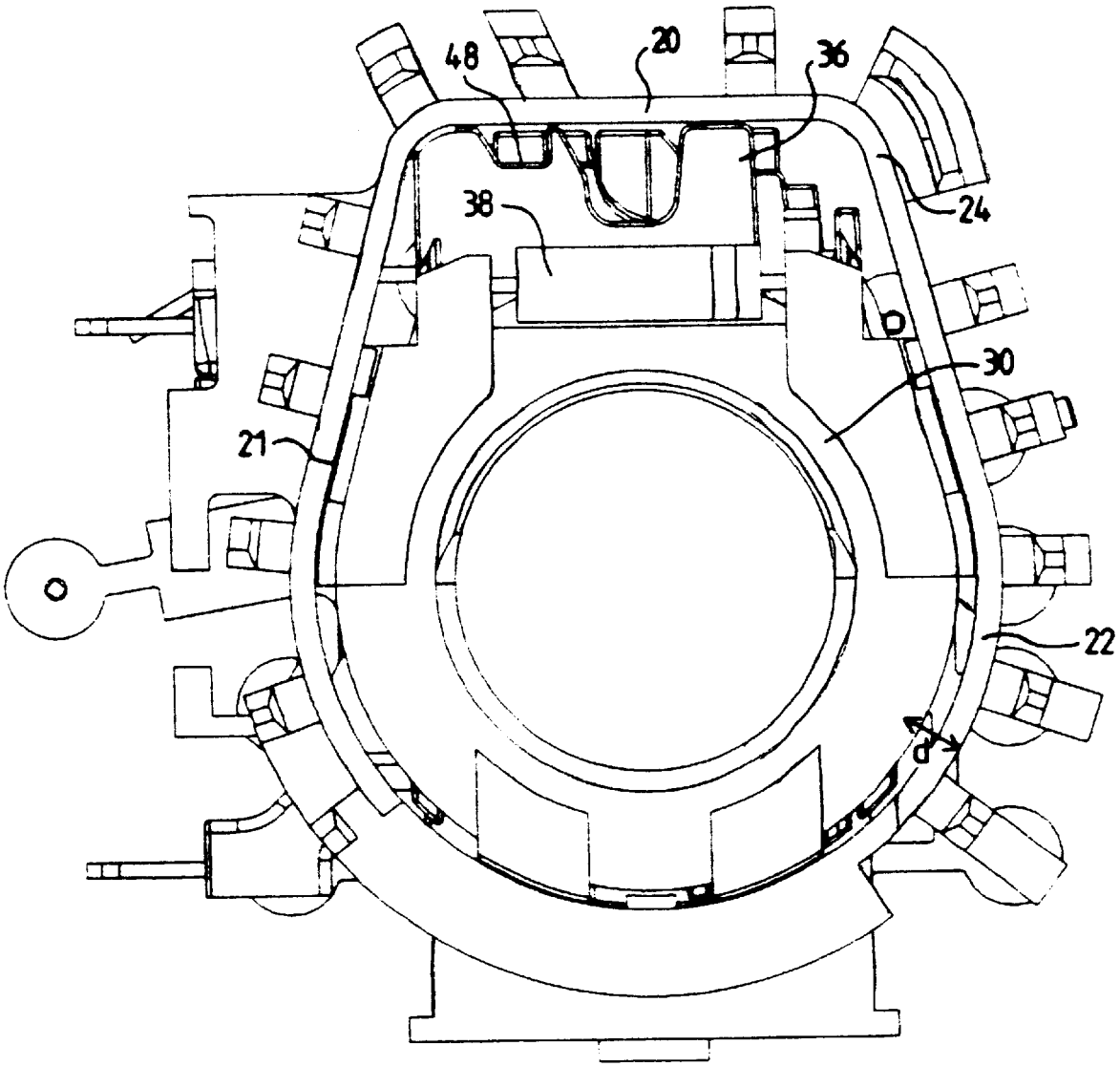
FIG. 5 represents the elements of FIG. 4 in a top view.
Figure 6:
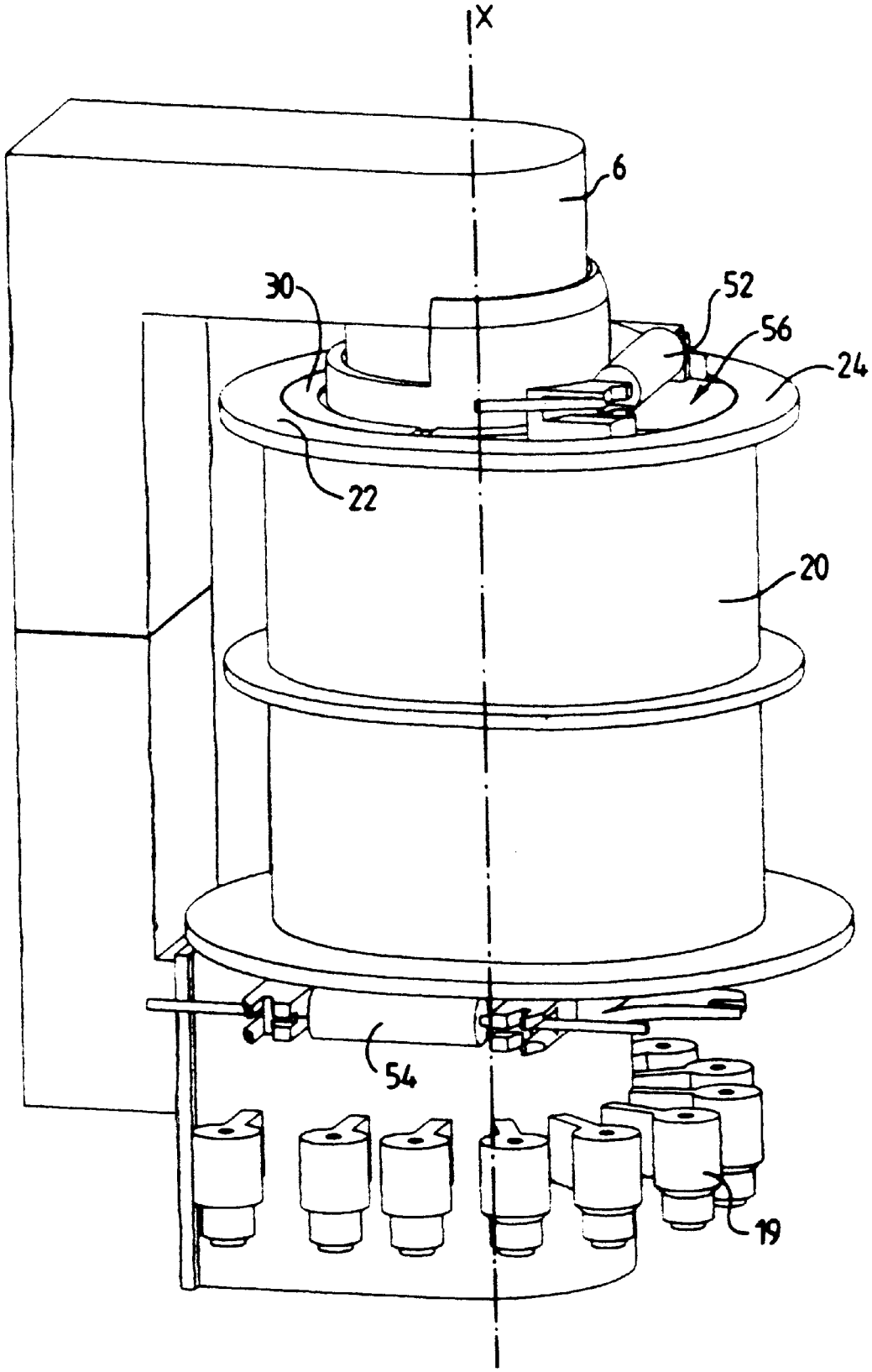
FIG. 6 represents the essential elements of a transformer according to a second embodiment of the invention.
Figure 7:
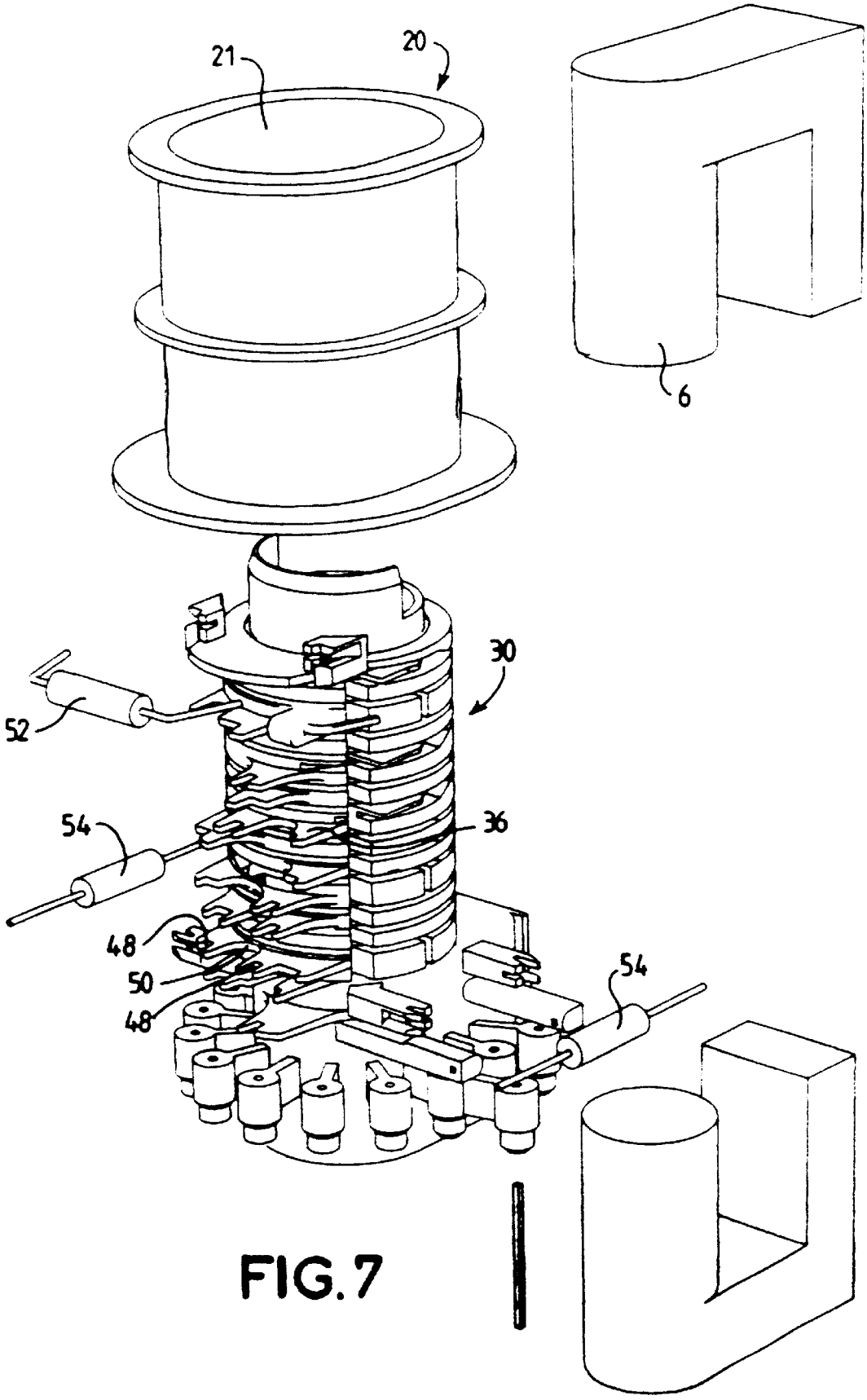
FIG. 7 represents the elements of FIG. 6 in an exploded view.
Figure 8:
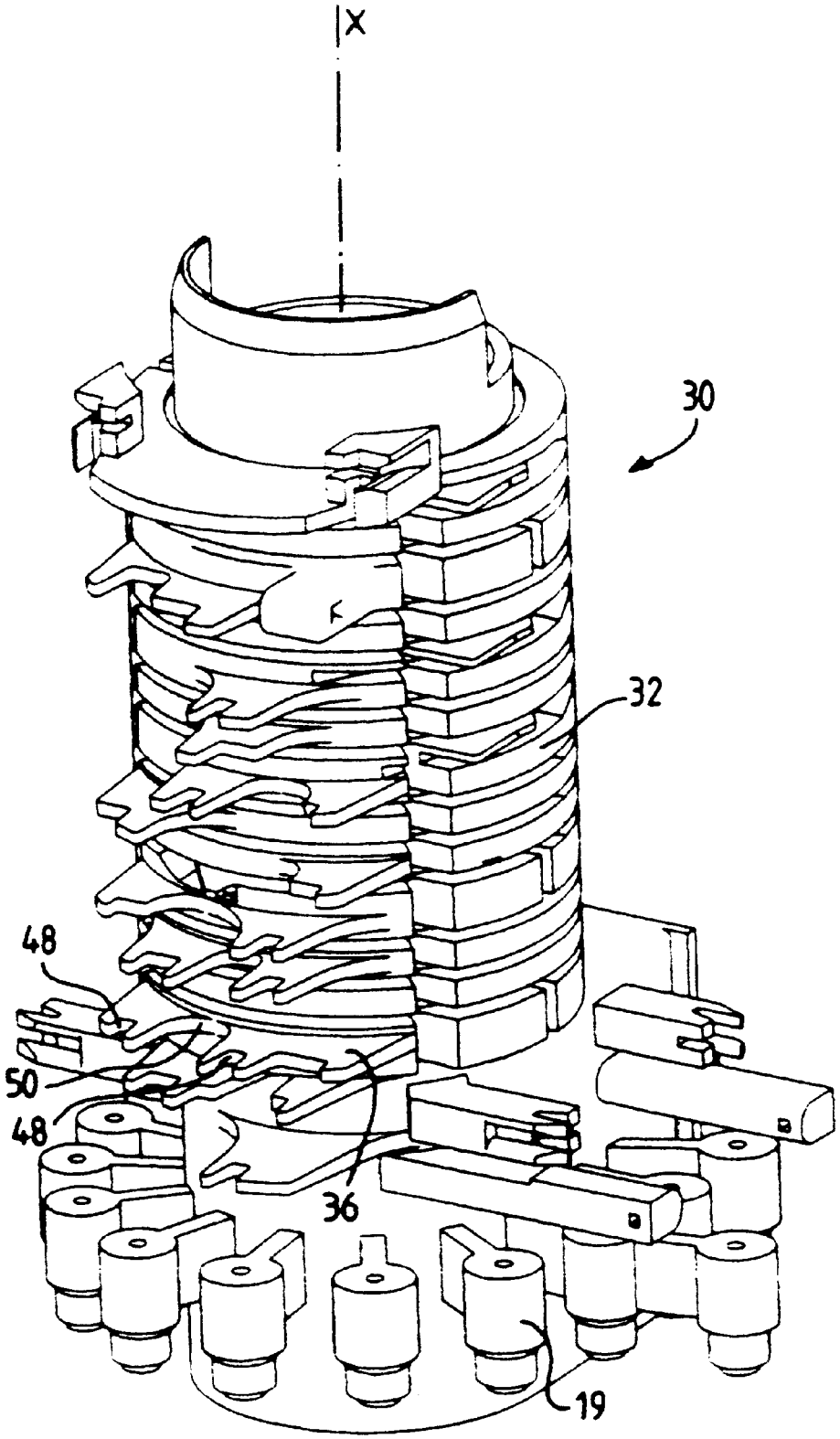
FIG. 8 represents an element of the transformer of FIG. 6.
Figure 9:
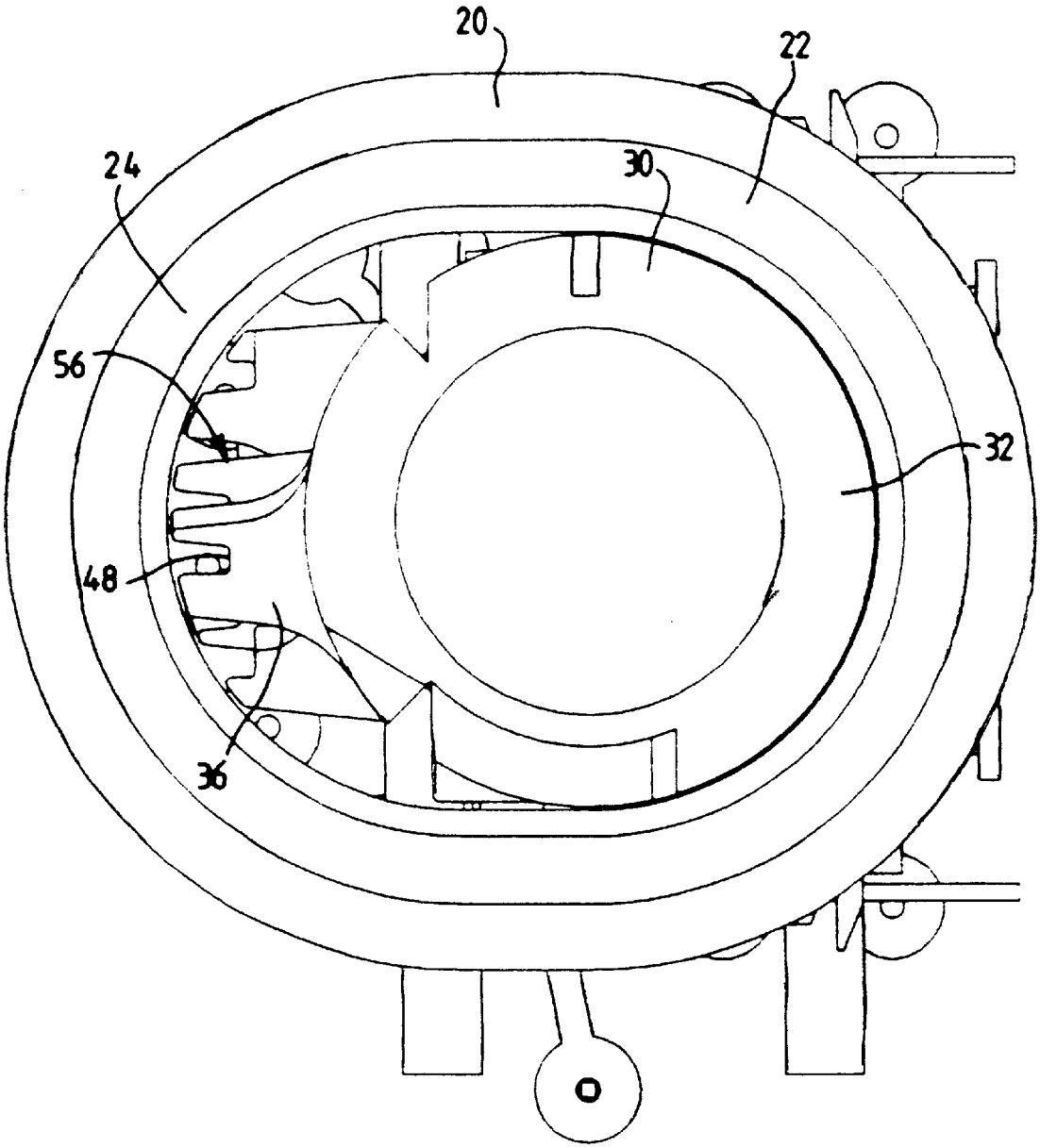
FIG. 9 represents a top view of the elements of the transformer of FIG. 6.

As is clearly visible in FIG. 5, the first support 20 is a substantially constant first distance d from the second support 30 over a first part 22 of its periphery and a distance greater than the first distance d over a second part 24 of its periphery. Thus the footprint of the assembly consisting of the first support 20 and second support 30 (stated otherwise the primary and secondary) is reduced to the minimum.

The second part 24 of the periphery of the first support 20 corresponds (angularly relative to the X axis) to the side where the second support 30 exhibits the flanges 36. Thus, the flanges 36 extend between the cylindrical part (upper part 32) of the second support 30 and the second part 24 of the first support 20.

The assembly of conductive wires which are essentially parallel to the X axis and guided in the indentations 48 of the flanges 36 is therefore situated between the upper part 32 of the second support 30 and the second part 24 of the first support 20, stated otherwise in line with the second part 24 perpendicularly to the X axis. This concentration of the conductive wires is made possible through the use of recesses 50 as described above.

Another embodiment of the invention is represented in FIGS. 6 to 9. The elements which are common to this embodiment and to the embodiment of FIGS. 1 to 5 will not be described again.

In this embodiment, the diodes 52, 54 (3 in number in the example represented) are situated outside the first support 20, and more precisely straddling the first support 20 relative to the X axis.

As previously, it is noted that the diodes 52, 54 are situated, perpendicular to the X axis, outside the window of the magnetic circuit 6. More precisely, a diode 52 is situated above the first support 20 along the X axis, away from the magnetic circuit 6 with respect to this same X axis; the two diodes 54 are situated under the first support 20 along the X axis straddling the magnetic circuit 6.

Furthermore, the first support 20 carries two primary windings (thus named even if only one of the two primary windings plays the role of primary in the electrical sense).

As in the embodiment described previously and as is clearly visible in FIG. 8, the second support 30 exhibits at the level of its upper part 32 of cylindrical general shape at least one flange 36 which possesses two indentations 48 for receiving a conductive wire and which are separated by a recess 50. The recess 50 is filled with the insulating material filling the vessel.

Over a first part 22 of the periphery of the first support 20, the upper part 32 of the second support 30 is a very small distance from the internal wall 21 of the first support 20, dubbed the first distance. Stated otherwise, over the first part 22 of its periphery, the first support 20 is almost in contact with the second support 30. In the embodiment represented, the first part 22 extends over 180° of the periphery of the first support 20.

The first support 20 has an oval shape so that over the remainder of its periphery, dubbed the second part 24, the distance between the first support 20 and the second support 24 is greater than the first distance. Between the internal wall 21 of the first support 20 and the upper part 32 of the second support 30 a space 56 is thus created in line with the second part 24. The space 56 receives the flanges 36 and the conductive wires parallel to the X axis and which connect the secondary windings to the diodes 52, 54 and to the connection lugs.

It may be noted moreover that the magnetic circuit 6 extends away from the space 56 with respect to the X axis.

What is claimed is:

1. A transformer comprising:

a first support carrying at least one primary winding, a second support carrying at least one partial secondary winding connected electrically to an electrical unit by way of conductive wires, wherein the second support comprises at least one flange which exhibits at least two indentations for receiving a conductive wire, and wherein the two indentations are separated by a recess of the flange filled with insulating material.

2. A transformer according to claim 1, wherein the second support is situated inside the first support.

3. A transformer according to claim 2, wherein the first support defines a periphery, wherein the first support is a substantially constant first distance from the second distance over a second part of the said periphery, and wherein the conductive wires are situated, between the first support and the second support, in line with said second part.

4. A transformer according to claims 1, wherein at least one diode is received between the second support and a partial secondary winding.

5. A transformer according to claim 3, wherein a magnetic circuit forms a window traversed by the first support and the second support at the level of said first part.

6. A transformer according to claim 5, wherein the assembly of electrical units is situated outside the magnetic circuit.

7. A transformer according to claim 1, wherein a first duct for receiving a first cable carries at least one clip for retaining a second cable associated with a second duct.

8. A transformer according to claim 1, wherein the first support and the second support are received in a vessel filled with said insulating material.

9. A transformer according to claim 8, wherein said insulating material is a resin.

10. Transformer according to claim 1 used for powering a cathode ray tube.

* * * * *